US012498122B2

(12) United States Patent
Zhou et al.

(10) Patent No.: US 12,498,122 B2
(45) Date of Patent: Dec. 16, 2025

(54) WALL-MOUNTED AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Baisong Zhou, Foshan (CN); Duode Wu, Foshan (CN); Bo Li, Foshan (CN); Yongqiang Wan, Foshan (CN); Qiqin Su, Foshan (CN); Yunchong Tu, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 111 days.

(21) Appl. No.: 18/563,853

(22) PCT Filed: Feb. 11, 2022

(86) PCT No.: PCT/CN2022/076093
§ 371 (c)(1),
(2) Date: Nov. 22, 2023

(87) PCT Pub. No.: WO2022/252682
PCT Pub. Date: Dec. 8, 2022

(65) Prior Publication Data

US 2024/0369235 A1 Nov. 7, 2024

(30) Foreign Application Priority Data

Jun. 1, 2021 (CN) ..... 202110610657.X

(51) Int. Cl.
*F24F 1/0314* (2019.01)
*F24F 1/0284* (2019.01)
*F24F 13/20* (2006.01)

(52) U.S. Cl.
CPC ..... *F24F 1/0314* (2019.02); *F24F 1/0284* (2019.02); *F24F 13/20* (2013.01)

(58) Field of Classification Search
CPC ..... F24F 1/0007; F24F 1/0025; F24F 1/0314; F24F 1/0011; F24F 1/0057; F24F 1/028;
(Continued)

(56) References Cited

U.S. PATENT DOCUMENTS

2018/0119984 A1 5/2018 Cho et al.
2021/0172454 A1* 6/2021 Wang ..... F24F 13/02

FOREIGN PATENT DOCUMENTS

CN 106369673 A 2/2017
CN 106403011 A 2/2017
(Continued)

OTHER PUBLICATIONS

JP2007170308 Machine Translation (Year: 2007).*
(Continued)

*Primary Examiner* — Joseph F Trpisovsky
(74) *Attorney, Agent, or Firm* — K&L Gates LLP

(57) ABSTRACT

Provided is a wall-mounted air conditioner. The wall-mounted air conditioner comprises a casing; the casing internally comprises an air duct; the air duct comprises an air intake channel and an air output channel, which are connected to each other; the air duct is provided with an air inlet and an air outlet; at least a part of the air inlet faces the front face of the wall-mounted air conditioner; and a first included angle, which is between a central line of the air intake channel and a central line of the air output channel, is greater than or equal to 10 degrees and less than or equal to 85
(Continued)

degrees. Since at least a part of the air inlet of the wall-mounted air conditioner is positioned on the front face of the casing, it is not necessary for air in the environment to enter the air duct from directly above the casing.

9 Claims, 4 Drawing Sheets

(58) Field of Classification Search
CPC ..... F24F 1/0284; F24F 13/02; F24F 13/20; F24F 13/08
See application file for complete search history.

(56) References Cited

FOREIGN PATENT DOCUMENTS

| | | | | | |
|---|---|---|---|---|---|
| CN | 215372681 | U | | 12/2021 | |
| CN | 215372682 | U | | 12/2021 | |
| CN | 216644347 | U | | 5/2022 | |
| EP | 1918658 | A2 | | 5/2008 | |
| JP | 53059247 | A | * | 5/1978 | |
| JP | S5359247 | A | | 5/1978 | |
| JP | H07293934 | A | | 11/1995 | |
| JP | H08110085 | A | | 4/1996 | |
| JP | H10311552 | A | | 11/1998 | |
| JP | 2007170308 | A | * | 7/2007 | |
| KR | 20020023532 | A | | 3/2002 | |
| KR | 20050058125 | A | | 6/2005 | |
| KR | 20080010682 | A | | 1/2008 | |
| WO | 2011016152 | A1 | | 2/2011 | |
| WO | 2016067408 | A1 | | 5/2016 | |
| WO | WO-2019001114 | A1 | * | 1/2019 | ..... F04D 17/04 |

OTHER PUBLICATIONS

JP53059247 Machine Translation (Year: 1978).*
OA Received in JP Application No. 2023565291; mailed.
Search Report received in EP application 22814731.0; mailed May 29, 2024.
ISR received in PCT application PCT/CN2022/076093; malled Apr. 7, 2022.
The First Office Action received in the counterpart CN application 202110610657.X, mailed on Apr. 1, 2025, 13 pages with English translation.

* cited by examiner

WALL-MOUNTED AIR CONDITIONER

CROSS-REFERENCES TO RELATED APPLICATIONS

The present disclosure is a national phase application of International Application No. PCT/CN2022/076093, filed on Feb. 11, 2022, which claims priority to and benefits of Chinese Patent Application No. 202110610657.X, filed on Jun. 1, 2021, the entire content of which is incorporated herein by reference.

FILED

This application relates to the field of air conditioners, and more particularly to a wall-mounted air conditioner.

BACKGROUND

In the related art, an air inlet of a wall-mounted air conditioner is at its top. In order to meet a requirement for air inflow from the top, the wall-mounted air conditioner has to be at a large distance from an indoor top wall, resulting in low indoor space utilization and making the indoor space more cramped. Moreover, the wall-mounted air conditioner in the related art has low heat exchange efficiency.

SUMMARY

Embodiments of the present disclosure propose a wall-mounted air conditioner.

The wall-mounted air conditioner according to embodiments of the present disclosure includes: a housing having an air duct therein. The air duct includes an inlet air duct and an outlet air duct connected to each other, and the air duct has an air inlet and an air outlet. At least a part of the air inlet faces a front surface of the wall-mounted air conditioner. A first intersection angle between a centerline of the inlet air duct and a centerline of the outlet air duct is greater than or equal to 10 degrees and less than or equal to 85 degrees.

According to the present disclosure, since at least a part of the air inlet of the wall-mounted air conditioner is on the front surface of the housing, ambient air (air inflow) can enter the air duct substantially from the front of the housing. For example, the ambient air (air inflow) can enter the air duct from the straight front of the housing, or from the top front of the housing, or from the bottom front of the housing. In addition, the ambient air can enter the air duct from at least two directions selected from the straight front of the housing, the top front of the housing, or from the bottom front of the housing.

That is, the ambient air does not necessarily enter the air duct directly above the housing. In such a way, a distance between the wall-mounted air conditioner and an indoor top wall can be greatly decreased or even eliminated, and the utilization rate of indoor space can be improved, especially for indoor space (rooms) with lower heights, which can effectively reduce or eliminate a cramped sense of the indoor space.

Therefore, the wall-mounted air conditioner according to embodiments of the present disclosure has a very low requirement for mounting space. As long as the wall-mounted air conditioner can be accommodated in the mounting space, there is no need to leave an air inflow space above the wall-mounted air conditioner, which can expand the applicability of the wall-mounted air conditioner.

In some embodiments, the air inlet is located on the front surface, inclined upwards towards the wall surface (which can be understood as a mounting surface) relative to a vertical surface. In this way, when a user standing on the ground of the room, the user cannot see the interior of the housing (the wall-mounted air conditioner) through the air inlet, and internal structures of the housing (the wall-mounted air conditioner) are not exposed to the user, which can improve the user's visual comfort.

In one embodiment, in a scenario of air inflow from the top, the top space is often restricted and relatively narrow, which limits the air inflow volume due to the narrow top space. In the embodiments of this application, since at least a part of the air inlet is located on the front surface of the housing, the air entering the air duct through the air inlet can directly flow through the heat exchanger for sufficient heat exchange with the heat exchanger. That is, the air inflow volume of the wall-mounted air conditioner is not limited by the narrow space at the top. The air inflow from the front surface of the housing can effectively increase the air inflow volume and significantly increase the air flow volume through the heat exchanger, greatly enhancing the heat exchange efficiency of the heat exchanger.

In the present disclosure, since at least a part of the air inlet is located on the front surface of the housing, there is no need to mount a roughly inverted V-shaped heat exchanger below the air inlet, and it is unnecessary to mount a water receiving tray with a width greater than or equal to a width of the roughly inverted V-shaped heat exchanger at a lower end of the heat exchanger, to avoid failure in heat exchange of air with a part of the heat exchanger due to the part being obstructed by the water receiving tray. Since at least a part of the air inlet is located on the front surface of the housing, the water receiving tray will not prevent airflow from flowing to the heat exchanger. For example, the water receiving tray does not pass an airflow path to the heat exchanger, which can greatly improve the heat exchange efficiency of the heat exchanger. In some embodiments, the water receiving tray is located below the heat exchanger.

Therefore, the wall-mounted air conditioner in the embodiments of the present disclosure has advantages of easy installation, improved indoor space utilization, wide applicability, and high heat exchange efficiency.

In some embodiments, a second intersection angle between the centerline of the outlet air duct and a vertical upward direction is greater than or equal to 120 degrees and less than or equal to 155 degrees.

In some embodiments, a duct wall of the air duct includes a first air inflow plate and a second air inflow plate that are oppositely arranged, and the duct wall of the air duct includes a first air outflow plate and a second air outflow plate that are oppositely arranged; and the inlet air duct is formed between the first air inflow plate and the second air inflow plate, and the outlet air duct is formed between the first air outflow plate and the second air outflow plate.

In some embodiments, the outlet air duct has a first end configured as the air outlet and a second end configured as an air guide port; a fan wheel is arranged in the air duct, and a surface passing through a rotation axis of the fan wheel and an upper edge of the air guide port is a first surface; and a third intersection angle between the first surface and a horizontal surface is greater than or equal to 60 degrees and less than or equal to 150 degrees.

In some embodiments, the outlet air duct has a first end configured as the air outlet and a second end configured as an air guide port; a fan wheel is arranged in the air duct, a surface passing through a rotation axis of the fan wheel and an upper edge of the air guide port is a first surface, and a surface passing through the rotation axis of the fan wheel and a lower edge of the air guide port is a second surface; and a fourth intersection angle between the first surface and the second surface is greater than or equal to 120 degrees and less than or equal to 200 degrees.

In some embodiments, the highest point of the second air inflow plate is located below the highest point of the first air inflow plate; the duct wall of the air duct further includes a volute tongue and an air guide plate; two sides of the air guide plate are respectively connected to the first air inflow plate and the first air outflow plate; two sides of the volute tongue are respectively connected to the second air inflow plate and the second air outflow plate; and the fan wheel is located between the volute tongue and the air guide plate.

In some embodiments, a minimum distance between the volute tongue and the fan wheel is greater than or equal to 4 millimeters and less than or equal to 9 millimeters.

In some embodiments, a minimum distance between the air guide plate and the fan wheel is greater than or equal to 4 millimeters and less than or equal to 8 millimeters.

In some embodiments, a fifth intersection angle between a first flat plate portion, adjacent to the air outlet, of the first air outflow plate and a second flat plate portion, adjacent to the air outlet, of the second air outflow plate is greater than or equal to 5 degrees and less than or equal to 45 degrees.

In some embodiments, a sixth intersection angle between a centerline of the outlet air duct and the second air outflow plate is greater than or equal to 0 degree and less than or equal to 30 degrees.

Figure 1:
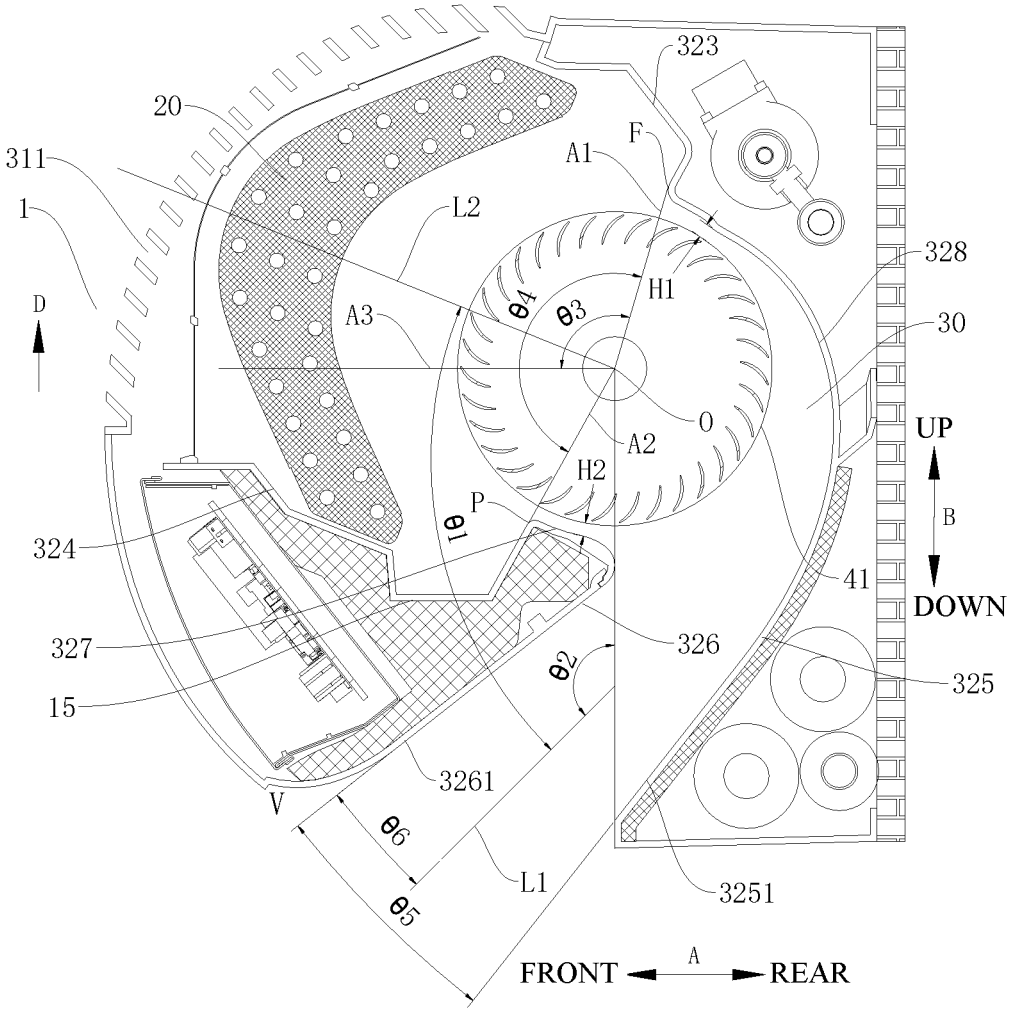
FIG. 1 is a sectional view of a wall-mounted air conditioner according to embodiments of the present disclosure.

REFERENCE NUMERALS wall-mounted air conditioner 1, wall surface 2, top wall 3, housing 10, front surface 11, top surface 12, rear surface 13, bottom surface 14, water receiving tray 15,
heat exchanger 20,
air duct 30, air inlet 311, air outlet 312,
inlet air duct 321, outlet air duct 322,
first air inflow plate 323, second air inflow plate 324, first air outflow plate 325, first flat plate portion 3251, second air outflow plate 326, second flat plate portion 3261, volute tongue 327, air guide plate 328,
fan wheel 40, outer contour 41,
centerline L1 of outlet air duct 322, centerline L2 of inlet air duct 321,
first surface A1, second surface A2, horizontal surface A3, base point O, first junction point F, second junction point P,
minimum distance H1 between air guide plate 328 and fan wheel 40,
minimum distance H2 between volute tongue 327 and fan wheel 40.

DETAILED DESCRIPTION OF THE DISCLOSURE

Embodiments of the present disclosure will be described in detail below, and examples of the embodiments will be shown in the accompanying drawings. The embodiments described below are exemplary and are intended to explain the present disclosure rather than limit the present disclosure.

Figure 4:
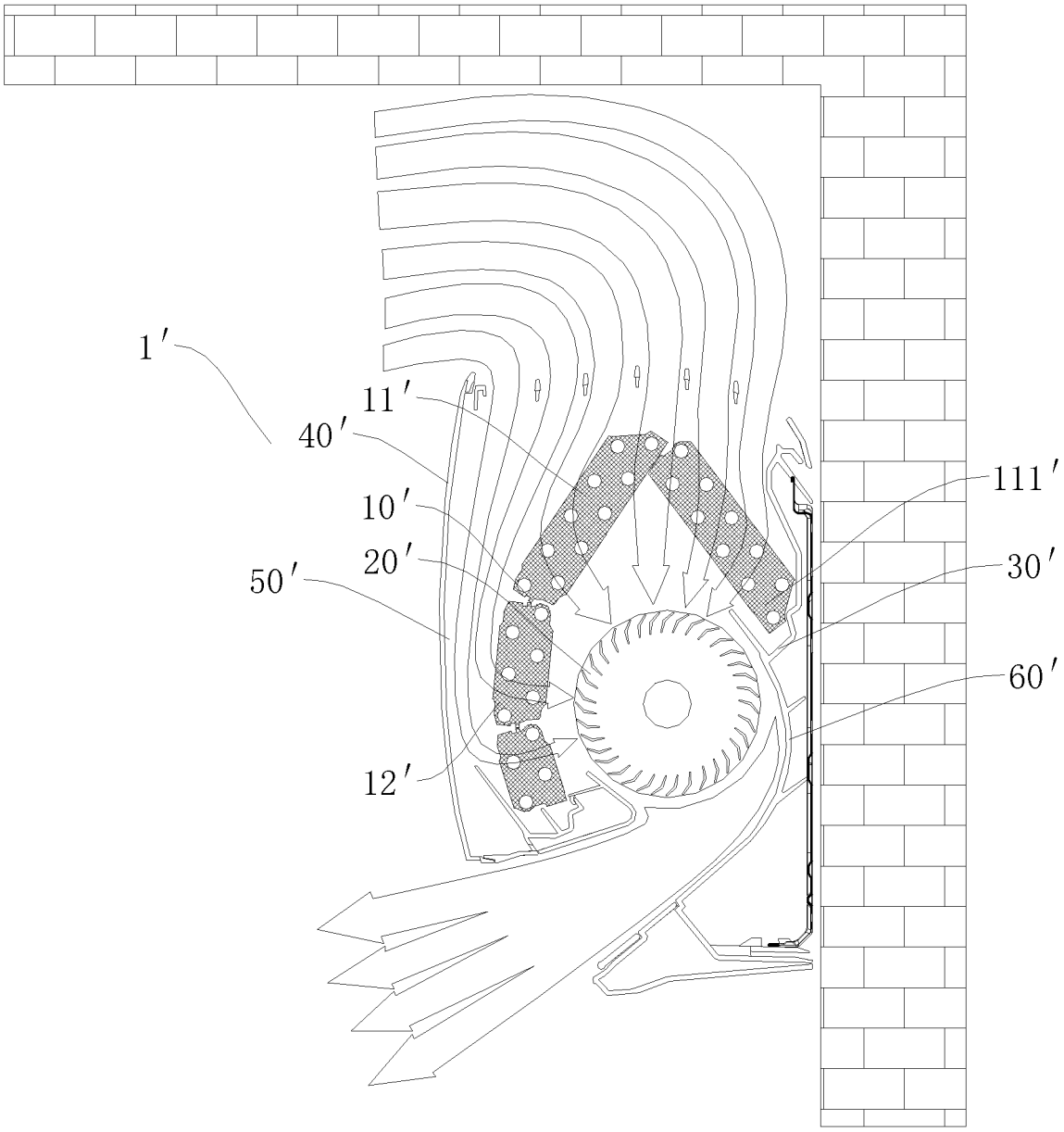
FIG. 4 is a sectional view of a wall-mounted air conditioner in the related art.

In the related art, as shown in FIG. 4, an air inlet of a wall-mounted air conditioner 1' is located at its top, and the top of the wall-mounted air conditioner 1' has to be at a large distance from an indoor top wall, to define an air inflow space. Consequently, the wall-mounted air conditioner 1' cannot be arranged tightly against the indoor top wall. A heat exchanger 10' of the wall-mounted air conditioner 1' is arranged around a cross-flow fan wheel 20'. In some embodiments, a first part 11' of the heat exchanger 10', which forms a roughly inverted V-shape, is located above the cross-flow fan wheel 20', and a second part 12' of the heat exchanger 10' is located in front of the cross-flow fan wheel 20'.

A water receiving tray 30' is provided below a rear lower end 111' of the first part 11'. The water receiving plate 30' is opposite to the rear lower end 111' of the first part 11' in an up-down direction and is located between the rear lower end 111' of the first part 11' and the cross-flow fan wheel 20'. The inventors have realized that the rear lower end 111' of the first part 11' is obstructed by the water receiving tray 30', and the rear lower end 111' of the first part 11' does not exchange heat with air, resulting in waste and lowering heat transfer efficiency.

An inlet air duct 50' is formed between the second part 12' and a front panel 40' of the wall-mounted air conditioner 1'. However, the inventors have realized that since most of the space in a front-rear direction of the wall-mounted air conditioner 1' is occupied by the heat exchanger 10', the cross-flow fan wheel 20' and a volute 60', the inlet air duct 50' is relatively narrow, resulting in a small air flow volume through the inlet air duct 50' and a low heat transfer efficiency of the second part 12'.

Figure 2:
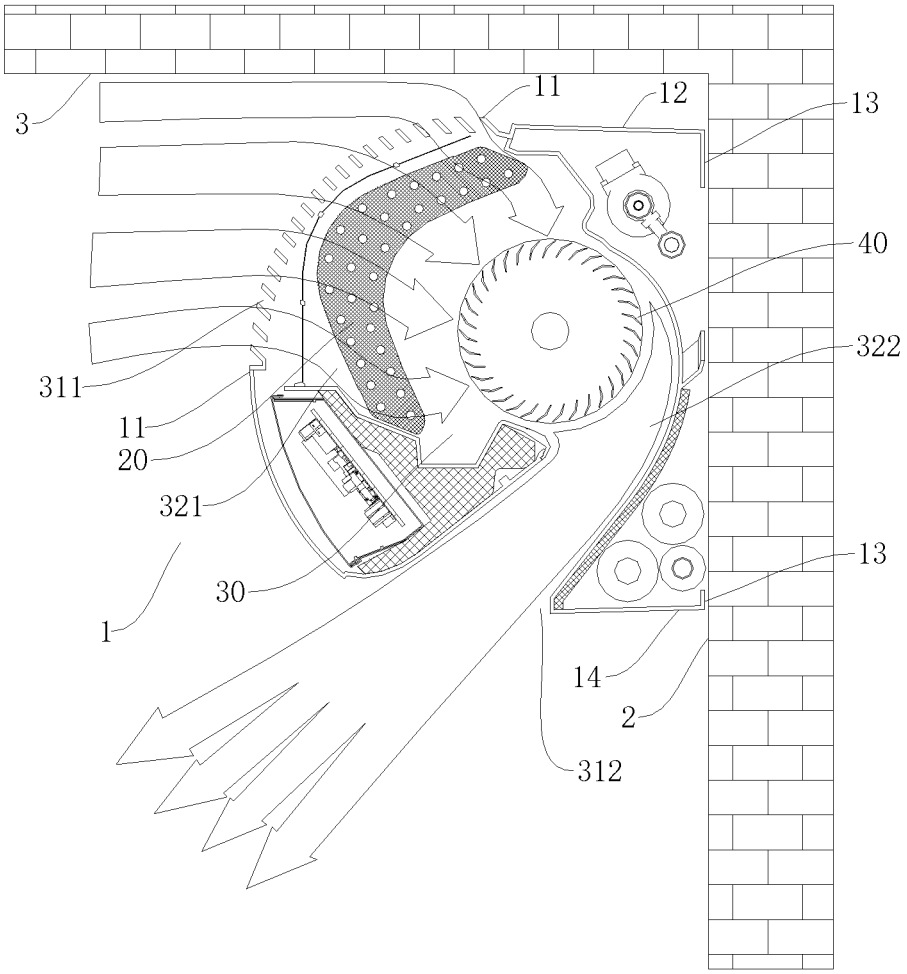
FIG. 2 is a sectional view of a wall-mounted air conditioner according to embodiments of the present disclosure.
Figure 3:
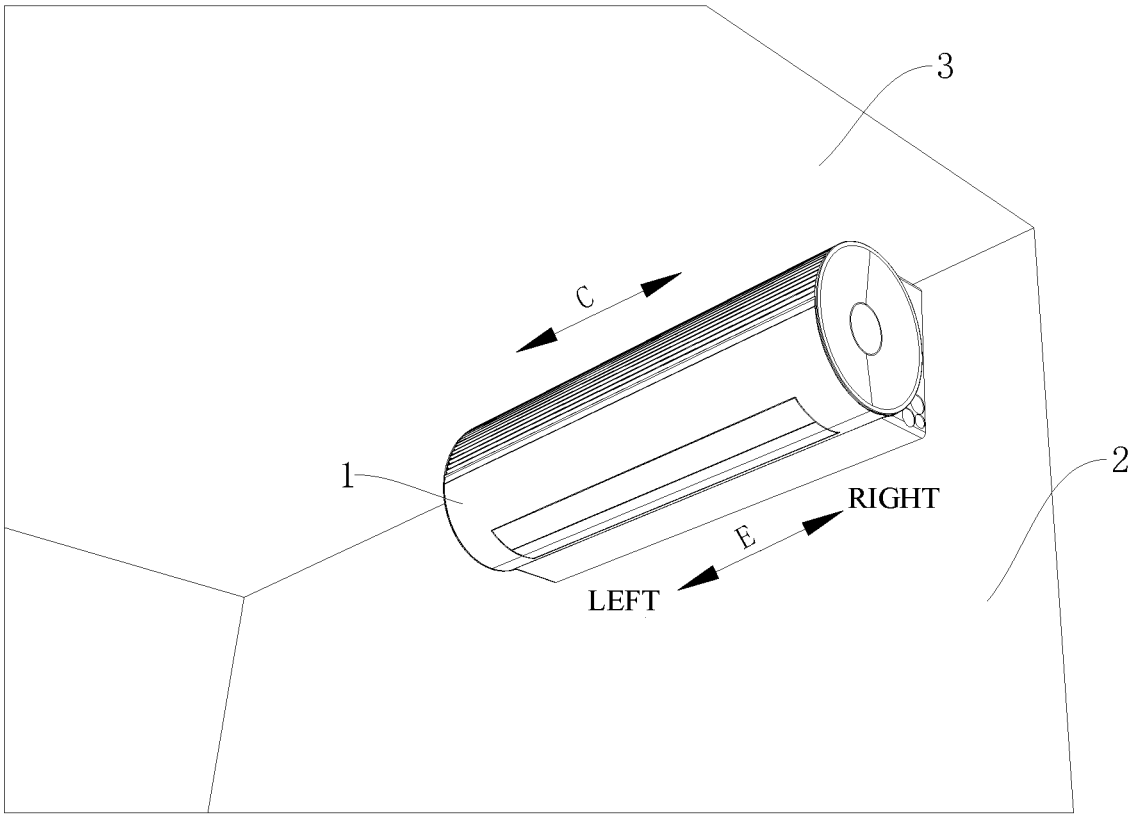
FIG. 3 is a schematic view of a wall-mounted air conditioner according to embodiments of the present disclosure.

A wall-mounted air conditioner 1 according to embodiments of the present disclosure will be described below according to the drawings. As shown in FIGS. 1-3, the wall-mounted air conditioner 1 according to embodiments of the present disclosure includes a housing 10. The housing 10 has an air duct 30 therein, and the air duct 30 includes an inlet air duct 321 and an outlet air duct 322 connected to each other. The air duct 30 has an air inlet 311 and an air outlet 312. At least a part of the air inlet 311 faces a front surface 11 of the wall-mounted air conditioner 1. A first intersection angle θ1 between a centerline L2 of the inlet air duct 321 and a centerline L1 of the outlet air duct 322 is greater than or equal to 10 degrees and less than or equal to 85 degrees. It is possible to avoid significant changes in a flow direction of air in the air duct 30, in order to reduce flow resistance against the air and allow the air to flow smoothly in the air duct 30, further improving the cooling and heating effect of the wall-mounted air conditioner 1.

For example, the front surface 11 of the wall-mounted air conditioner 1 is also a front surface 11 of the housing 10. Therefore, the fact that at least a part of the air inlet 311 faces the front surface 11 of the wall-mounted air conditioner 1 means that at least a part of the air inlet 311 is on the front surface 11 of the housing 10. The front surface 11 of the housing 10 is a surface that can be seen by a horizontal backward line of sight, that is, a surface of the housing 10 that can be seen by the horizontal backward line of sight is the front surface 11 of the housing 10. For example, when an observer's eyes are roughly at the same level as the housing 10 and the observer is in front of the housing 10, a surface of the housing 10 that the observer can see is the front surface 11 of the housing 10. A top surface 12 of the housing 10 is a surface on the top of the housing 10 and is generally invisible to the observer in front of the housing 10.

A front-rear direction is shown by arrow A in FIG. 1, and an up-down direction is shown by arrow B in FIG. 1. For example, the wall-mounted air conditioner 1 is mounted on a wall surface 2. A direction away from the wall surface 2 in the horizontal direction represents a forward direction, and a direction heading to the wall surface 2 in the horizontal direction represents a rearward direction.

According to the present disclosure, since at least a part of the air inlet of the wall-mounted air conditioner is on the front surface of the housing, ambient air (air inflow) can enter the air duct substantially from the front of the housing. For example, the ambient air (air inflow) can enter the air duct from the straight front of the housing, or from the top front of the housing, or from the bottom front of the housing. In addition, the ambient air can enter the air duct from at least two directions selected from the straight front of the housing, the top front of the housing, or from the bottom front of the housing.

That is, the ambient air does not necessarily enter the air duct directly above the housing. In such a way, a distance between the wall-mounted air conditioner and an indoor top wall can be greatly decreased or even eliminated, and the utilization rate of indoor space can be improved, especially for indoor space (rooms) with lower heights, which can effectively reduce or eliminate a cramped sense of the indoor space.

Therefore, the wall-mounted air conditioner according to embodiments of the present disclosure has a very low requirement for mounting space. As long as the wall-mounted air conditioner can be accommodated in the mounting space, there is no need to leave an air inflow space above the wall-mounted air conditioner, which can expand the applicability of the wall-mounted air conditioner.

In some embodiments, the air inlet 311 is located on the front surface, inclined upwards towards the wall surface 2 (which can be understood as a mounting surface) relative to a vertical surface. In this way, when a user standing on the ground of the room, the user cannot see the interior of the housing 10 (the wall-mounted air conditioner 1) through the air inlet 311, and internal structures of the housing 10 (the wall-mounted air conditioner 1) are not exposed to the user, which can improve the user's visual comfort.

In one embodiment, in a scenario of air inflow from the top, the top space is often restricted and relatively narrow, which limits the air inflow volume due to the narrow top space. In the embodiments of this application, since at least a part of the air inlet is located on the front surface of the housing, the air entering the air duct through the air inlet can directly flow through the heat exchanger for sufficient heat exchange with the heat exchanger. That is, the air inflow volume of the wall-mounted air conditioner is not limited by the narrow space at the top. The air inflow from the front surface of the housing can effectively increase the air inflow volume and significantly increase the air flow volume through the heat exchanger, greatly enhancing the heat exchange efficiency of the heat exchanger.

In the present disclosure, since at least a part of the air inlet 311 is located on the front surface of the housing 10, there is no need to mount a roughly inverted V-shaped heat exchanger below the air inlet 311, and it is unnecessary to mount a water receiving tray with a width greater than or equal to a width of the roughly inverted V-shaped heat exchanger at a lower end of the heat exchanger, to avoid failure in heat exchange of air with a part of the heat exchanger due to the part being obstructed by the water receiving tray. Since at least a part of the air inlet 311 is located on the front surface of the housing 10, the water receiving tray 15 will not prevent airflow from flowing to the heat exchanger. For example, the water receiving tray 15 does not pass an airflow path to the heat exchanger 20, which can greatly improve the heat exchange efficiency of the heat exchanger 20. In some embodiments, the water receiving tray 15 is located below the heat exchanger 20.

Therefore, the wall-mounted air conditioner in the embodiments of the present disclosure has advantages of easy installation, improved indoor space utilization, wide applicability, and high heat exchange efficiency.

In some embodiments, the first intersection angle θ1 is greater than or equal to 20 degrees and less than or equal to 80 degrees. In some embodiments, the first intersection angle θ1 is greater than or equal to 40 degrees and less than or equal to 75 degrees. In some embodiments, the first intersection angle θ1 greater than or equal to 60 degrees and less than or equal to 75 degrees. In some embodiments, the first intersection angle θ1 greater than or equal to 70 degrees and less than or equal to 75 degrees. Consequently, the air can flow more smoothly in the air duct 30 and the cooling and heating effect of the wall-mounted air conditioner 1 can be further improved.

In some embodiments, the first intersection angle θ1 may be 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 71 degrees, 72 degrees, 73 degrees, 74 degrees, 75 degrees, 76 degrees, 77 degrees, 78 degrees, 79 degrees, 80 degrees, or 85 degrees. As shown in FIGS. 1-3, the wall-mounted air conditioner 1 according to embodiments of the present disclosure includes THE housing 10 and the heat exchanger 20. The housing 10 can be mounted on the wall surface 2 indoors. A distance between the top surface 12 of the housing 10 and an indoor top wall 3 is less than or equal to 20 centimeters. In other words, a minimum distance between the housing 10 and the indoor top wall 3 in the up-down direction is less than or equal to 20 centimeters, which can further improve the utilization rate of indoor space. In some embodiments, the distance between the top surface 12 of the housing 10 and an indoor top wall 3 is less than or equal to 15 centimeters. In some embodiments, the distance between the top surface 12 of the housing 10 and an indoor top wall 3 is less than or equal to 10 centimeters. In some embodiments, the distance between the top surface 12 of the housing 10 and an indoor top wall 3 is less than or equal to 8 centimeters. In some embodiments, the distance between the top surface 12 of the housing 10 and an indoor top wall 3 is less than or equal to 5 centimeters.

As shown in FIGS. 1 to 3, in an embodiment of the present disclosure, an upper edge of the front surface 11 of the housing 10 is connected to a rear surface 13 of the housing 10 through the top surface 12 of the housing 10. A lower edge of the front surface 11 of the housing 10 is directly connected to the rear surface 13 of the housing 10, or the lower edge of the front surface 11 of the housing 10 is connected to the rear surface 13 of the housing 10 through a bottom surface 14 of the housing 10. In such a way, the appearance of the housing 10 and hence the wall-mounted air conditioner 1 becomes neater and more aesthetic.

The top surface 12 may be a horizontal surface. That is, the top surface 12 may extend horizontally backwards from the front surface 11, and the top surface 12 cannot be seen by the horizontal backward line of sight. In addition, the top surface 12 may also be an inclined surface that tilts backwards and downwards. That is, the top surface 12 may be an inclined surface, and the top surface 12 may extend backwards and downwards from the front surface 11, and the top surface 12 cannot be seen by the horizontal backward line of sight.

The heat exchanger 20 is arranged inside the housing 10. The air duct 30 is inside the housing 10 and has the air inlet 311 and the air outlet 312. In some embodiments, a position of the air outlet 312 is lower than a position of the air inlet 311, which makes the structure of the wall-mounted air conditioner 1 more reasonable.

As shown in FIGS. 1 and 2, the wall-mounted air conditioner 1 further includes a fan wheel 40 arranged in the air duct 30, and the heat exchanger 20 is arranged between the air inlet 311 and the fan wheel 40. The arrangement of the fan wheel 40 in the air duct 30 can increase the flow volume and velocity of air passing through the heat exchanger 20, to further improve the heat exchange efficiency of the heat exchanger 20 and the wall-mounted air conditioner 1.

In some embodiments, as shown in FIGS. 1 and 2, the fan wheel 40 is at a junction of the inlet air duct 321 and the outlet air duct 322, which can make the structure of the wall-mounted air conditioner 1 more reasonable. For example, a part of the fan wheel 40 is inside the inlet air duct 321, and a remaining part of the fan wheel 40 is inside the outlet air duct 322.

As shown in FIGS. 1 and 2, in a vertical plane perpendicular to a length direction of the air duct 30, a second intersection angle θ2 between the centerline L1 of the outlet air duct 322 and a vertical upward direction is greater than or equal to 120 degrees and less than or equal to 155 degrees. In such a way, the air leaving the outlet air duct 322 can flow downwards and forwards, that is, the wall-mounted air conditioner 1 can discharge cold air (hot air) downwards and forwards, which can further improve the cooling and heating effect of the wall-mounted air conditioner 1. The vertical upward direction is as indicated by arrow D in FIG. 1. The length direction of the air duct 30 is shown by arrow C in FIG. 3. A length direction of the wall-mounted air conditioner 1 may be consistent with the length direction of the air duct 30.

In one embodiment, there may be a mounting space in front and/or rear of the outlet air duct 322, to allow the components originally mounted on a side (such as a left side and/or a right side) of the length direction of the air duct 30 to be mounted in the mounting space. Consequently, the length of the wall-mounted air conditioner 1 can be effectively decreased, and the installation difficulty of and space required for the wall-mounted air conditioner 1 can be reduced. A left-right direction is as indicated by arrow E in FIG. 3. Electric control components, pipelines, circuits, throttling components and the like can be mounted in the mounting space.

In some embodiments, the second intersection angle θ2 is greater than or equal to 130 degrees and less than or equal to 150 degrees. In one embodiment, the second intersection angle θ2 is greater than or equal to 140 degrees and less than or equal to 145 degrees. The flow direction of the cold air (hot air) discharged from the wall-mounted air conditioner 1 can be further optimized to improve the cooling and heating effect of the wall-mounted air conditioner 1.

In one embodiment, the second intersection angle θ2 may be but is not limited to 120 degrees, 125 degrees, 130 degrees, 135 degrees, 140 degrees, 141 degrees, 142 degrees, 143 degrees, 144 degrees, 145 degrees, 150 degrees, or 155 degrees.

As shown in FIGS. 1 and 2, a channel wall of the outlet air duct 322 includes a first air outflow plate 325 and a second air outflow plate 326 that are oppositely arranged; and a channel wall of the inlet air duct 321 includes a first air inflow plate 323 and a second air inflow plate 324 that are oppositely arranged. The outlet air duct 322 is formed between the first air outflow plate 325 and the second air outflow plate 326. The inlet air duct 321 is formed between the first air inflow plate 323 and the second air inflow plate 324.

In some embodiments, at least a part of the first air outflow plate 325 is located behind at least a part of the second air outflow plate 326, and at least a part of the first air inflow plate 323 is located above at least a part of the second air inflow plate 324. The highest point of the second air inflow plate 324 is located below the highest point of the first air inflow plate 323, which can make the structure of the air duct 30 more reasonable.

The outlet air duct 322 has a first end configured as the air outlet 312 and a second end configured as an air guide port (an opening, adjacent to the inlet air duct 321, of the outlet air duct 322, i.e., an air inlet of the outlet air duct 322). A surface passing through a rotation axis of the fan wheel 40 and an upper edge of the air guide port is a first surface A1, and a surface passing through the rotation axis of the fan wheel 40 and a lower edge of the air guide port is a second surface A2. In the vertical plane perpendicular to the length direction of the air duct 30, a projection of the rotation axis of the fan wheel 40 is a base point O in FIG. 1, a projection of the upper edge of the air guide port is a first junction point F in FIG. 1, and a projection of the lower edge of the air guide port is a second junction point P in FIG. 1. The first surface A1 passes through the base point O and the first junction point F, while the second surface A2 passes through the base point O and the second junction point P. A third intersection angle θ3 between the first surface A1 and a horizontal surface A3 is greater than or equal to 60 degrees and less than or equal to 150 degrees.

At least a part of the air inlet of the outlet air duct 322 (the air guide port of the outlet air duct 322) is opened forwards and upwards, allowing the air flowing through the air inlet 311 and the inlet air duct 321 to enter the outlet air duct 322 more smoothly, to improve the cooling and heating effect of the wall-mounted air conditioner 1. In other words, at least a part of an air outlet (an opening of the inlet air duct 321 adjacent to the outlet air duct 322) of the inlet air duct 321 can be opened backwards and downwards, enabling the air in the inlet air duct 321 to enter the outlet air duct 322 more smoothly, to improve the cooling and heating effect of the wall-mounted air conditioner 1.

In some embodiments, the third intersection angle θ3 is greater than or equal to 70 degrees and less than or equal to 130 degrees. In some embodiments, the third intersection angle θ3 is greater than or equal to 80 degrees and less than or equal to 120 degrees. In some embodiments, the third intersection angle θ3 is greater than or equal to 90 degrees and less than or equal to 110 degrees. Consequently, the air flowing through the air inlet 311 and the inlet air duct 321 can enter the outlet air duct 322 more smoothly, further improving the cooling and heating effect of the wall-mounted air conditioner 1.

In some embodiments, the third intersection angle θ3 may be 60 degrees, 65 degrees, 70 degrees, 75 degrees, 80 degrees, 85 degrees, 90 degrees, 92 degrees, 95 degrees, 100 degrees, 102 degrees, 105 degrees, 110 degrees, 115 degrees, 120 degrees, 125 degrees, 130 degrees, 135 degrees, 140 degrees, 145 degrees, or 150 degrees.

As shown in FIGS. 1 and 2, a fourth intersection angle θ4 between the first surface A1 and the second surface A2 is greater than or equal to 120 degrees and less than or equal to 200 degrees. That is, an intersection angle between a straight line OF and a straight line OP is greater than or equal to 120 degrees and less than or equal to 200 degrees.

The air inlet of the outlet air duct 322 can have a larger inlet angle, to allow more air to enter the outlet air duct 322 and ensure a larger air flow volume in the outlet air duct 322. Hence, the wall-mounted air conditioner 1 can have a larger air outflow volume, further improving the cooling and heating effect of the wall-mounted air conditioner 1.

In some embodiments, the fourth intersection angle θ4 is greater than or equal to 130 degrees and less than or equal to 190 degrees. In some embodiments, the fourth intersection angle θ4 is greater than or equal to 140 degrees and less than or equal to 180 degrees. In some embodiments, the fourth intersection angle θ4 is greater than or equal to 155 degrees and less than or equal to 175 degrees. It is possible to ensure the large air flow volume through the outlet air duct 322 and the large air outflow volume of the wall-mounted air conditioner 1, to improve the cooling and heating effect of the wall-mounted air conditioner 1. The fourth intersection angle θ4 may be a suction angle of the fan wheel 40.

In some embodiments, the fourth intersection angle θ4 may be 120 degrees, 125 degrees, 130 degrees, 135 degrees, 140 degrees, 145 degrees, 150 degrees, 152 degrees, 155 degrees, 157 degrees, 160 degrees, 162 degrees, 165 degrees, 167 degrees, 170 degrees, 172 degrees, 175 degrees, 180 degrees, 185 degrees, 190 degrees, 195 degrees, or 200 degrees.

As shown in FIGS. 1 and 2, the first air outflow plate 325 includes a first flat plate portion 3251 adjacent to the air outlet 312, and the second air outflow plate 326 includes a second flat plate portion 3261 adjacent to the air outlet 312. Inner edges of projections of the first flat plate portion 3251 and the second flat plate portion 3261 on the vertical plane perpendicular to the length direction of the air duct 30 are both straight lines.

Further, a fifth intersection angle θ5 between the first flat plate portion 3251 and the second flat plate portion 3261 is greater than or equal to 5 degrees and less than or equal to 45 degrees. As a result, the air flow volume through the outlet air duct 322 (i.e., the air outflow volume of the outlet air duct 322) can be ensured, and meanwhile the space occupied by the outlet air duct 322 can be reduced, to provide sufficient mounting space in front of and/or behind the outlet air duct 322, allowing the components originally mounted on the side (such as the left side and/or the right side) of the length direction of the air duct 30 to be mounted in the mounting space. Consequently, the length of the wall-mounted air conditioner 1 can be effectively decreased, and the installation difficulty of and space required for the wall-mounted air conditioner 1 can be reduced.

In some embodiments, the fifth intersection angle θ5 is greater than or equal to 10 degrees and less than or equal to 40 degrees. In some embodiments, the fifth intersection angle θ5 is greater than or equal to 10 degrees and less than or equal to 30 degrees. In some embodiments, the fifth intersection angle θ5 is greater than or equal to 10 degrees and less than or equal to 20 degrees. In such a way, the air flow volume through the outlet air duct 322 can be increased, and the mounting space in front of and/or behind the outlet air duct 322 can be enlarged, which can further enhance the cooling and heating effect of the wall-mounted air conditioner 1, decrease the length of the wall-mounted air conditioner 1, and reduce the installation difficulty and space required for the wall-mounted air conditioner 1.

In some embodiments, the fifth intersection angle θ5 may be 5 degrees, 10 degrees, 11 degrees, 12 degrees, 13 degrees, 14 degrees, 15 degrees, 16 degrees, 17 degrees, 18 degrees, 19 degrees, 20 degrees, 25 degrees, 30 degrees, 35 degrees, 40 degrees, or 45 degrees.

A sixth intersection angle θ6 between the centerline L1 of the outlet air duct 322 and the second flat plate portion 3261 is greater than or equal to 0 degree and less than or equal to 30 degrees. As a result, the air flow volume through the outlet air duct 322 (i.e., the air outflow volume of the outlet air duct 322) can be ensured, and meanwhile the space occupied by the outlet air duct 322 can be reduced, to provide sufficient mounting space in front of and/or behind the outlet air duct 322, allowing the components originally mounted on the side (such as the left side and/or the right side) of the length direction of the air duct 30 to be mounted in the mounting space. Consequently, the length of the wall-mounted air conditioner 1 can be effectively decreased, and the installation difficulty of and space required for the wall-mounted air conditioner 1 can be reduced.

In some embodiments, the sixth intersection angle θ6 is greater than or equal to 1 degree and less than or equal to 25 degrees. In some embodiments, the sixth intersection angle θ6 is greater than or equal to 2 degrees and less than or equal to 20 degrees. In some embodiments, the sixth intersection angle θ6 is greater than or equal to 3 degrees and less than or equal to 10 degrees. In such a way, the air flow volume through the outlet air duct 322 can be increased, and the mounting space in front of and/or behind the outlet air duct 322 can be enlarged, which can further enhance the cooling and heating effect of the wall-mounted air conditioner 1, decrease the length of the wall-mounted air conditioner 1, and reduce the installation difficulty and space required for the wall-mounted air conditioner 1.

In some embodiments, the sixth intersection angle θ6 may be 1 degree, 2 degrees, 3 degrees, 4 degrees, 5 degrees, 6 degrees, 7 degrees, 8 degrees, 9 degrees, 10 degrees, 15 degrees, 20 degrees, 25 degrees, or 30 degrees.

As shown in FIGS. 1 and 2, a duct wall of the air duct 30 also includes a volute tongue 327 and an air guide plate 328. Two sides of the air guide plate 328 are respectively connected to the first air inflow plate 323 and the first air outflow plate 325. Two sides of the volute tongue 327 are respectively connected to the second air inflow plate 324 and the second air outflow plate 326. The fan wheel 40 is located between the volute tongue 327 and the air guide plate 328.

A minimum distance H1 between the air guide plate 328 and the fan wheel 40 is greater than or equal to 4 millimeters and less than or equal to 8 millimeters. In some embodiments, the minimum distance H1 between the air guide plate 328 and an outer contour 41 of a projection of the fan wheel 40 is greater than or equal to 4 millimeters and less than or equal to 8 millimeters. In such a way, the air flow volume through the outlet air duct 322 (i.e., the air outflow volume of the outlet air duct 322) can be ensured and meanwhile the space occupied by the air duct 30 can be reduced, to reduce the space occupied by the wall-mounted air conditioner 1.

In some embodiments, the minimum distance H1 between the air guide plate 328 and the fan wheel 40 is greater than or equal to 5 millimeters and less than or equal to 7 millimeters. In some embodiments, the minimum distance H1 between the air guide plate 328 and the fan wheel 40 is greater than or equal to 5.5 millimeters and less than or equal to 6.5 millimeters. In some embodiments, the minimum distance H1 between the air guide plate 328 and the fan wheel 40 is greater than or equal to 5.6 millimeters and less than or equal to 5.9 millimeters. In such a way, the air flow volume through the outlet air duct 322 (i.e., the air outflow volume of the outlet air duct 322) can be ensured and meanwhile the space occupied by the air duct 30 can be reduced, to reduce the space occupied by the wall-mounted air conditioner 1.

In some embodiments, the minimum distance H1 between the air guide plate 328 and the fan wheel 40 can be 4 millimeters, 4.5 millimeters, 5 millimeters, 5.5 millimeters, 5.6 millimeters, 5.7 millimeters, 5.75 millimeters, 5.8 millimeters, 5.9 millimeters, 6 millimeters, 6.5 millimeters, 7 millimeters, 7.5 millimeters, or 8 millimeters, for example.

The minimum distance H1 between the air guide plate 328 and the fan wheel 40 is a minimum distance between any point of the air guide plate 328 and any point of the outer contour 41 of the fan wheel 40.

As shown in FIGS. 1 and 2, a minimum distance H2 between the volute tongue 327 and the fan wheel 40 is greater than or equal to 4 millimeters and less than or equal to 9 millimeters. It is possible to allow air to enter the outlet air duct 322 more smoothly and achieve a large air flow volume in the outlet air duct 322. Hence, the wall-mounted air conditioner 1 can have a larger air outflow volume, further improving the cooling and heating effect of the wall-mounted air conditioner 1. In some embodiments, the minimum distance H2 between the volute tongue 327 and the fan wheel 40 is greater than or equal to 6 millimeters and less than or equal to 8 millimeters. In some embodiments, the minimum distance H2 between the volute tongue 327 and the fan wheel 40 is greater than or equal to 7.1 millimeters and less than or equal to 7.9 millimeters. It is possible to allow air to enter the outlet air duct 322 more smoothly and achieve a large air flow volume in the outlet air duct 322. Hence, the wall-mounted air conditioner 1 can have a larger air outflow volume, further improving the cooling and heating effect of the wall-mounted air conditioner 1. In some embodiments, the minimum distance H2 between the volute tongue 327 and the fan wheel 40 may be, for example, 5 millimeters, 5.5 millimeters, 6 millimeters, 6.5 millimeters, 7 millimeters, 7.1 millimeters, 7.2 millimeters, 7.3 millimeters, 7.4 millimeters, 7.5 millimeters, 7.6 millimeters, 7.7 millimeters, 7.8 millimeters, 7.9 millimeters, 8 millimeters, 8.5 millimeters, or 9 millimeters.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Further, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Further, the particular features, structures, materials, or characteristics may be combined in any suitable manner in one or more embodiments or examples.

What is claimed is:

1. A wall-mounted air conditioner, comprising a housing having an air duct therein, wherein the air duct comprises an inlet air duct and an outlet air duct connected to each other, and the air duct has an air inlet and an air outlet;

at least a part of the air inlet faces a front surface of the wall-mounted air conditioner;

a first intersection angle between a centerline of the inlet air duct and a centerline of the outlet air duct is greater than or equal to 10 degrees and less than or equal to 85 degrees;

a duct wall of the air duct comprises a first air inflow plate and a second air inflow plate that are oppositely arranged, and the duct wall of the air duct comprises a first air outflow plate and a second air outflow plate that are oppositely arranged;

the inlet air duct is formed between the first air inflow plate and the second air inflow plate, and the outlet air duct is formed between the first air outflow plate and the second air outflow plate; and the duct wall of the air duct further comprises a volute tongue and an air guide plate; two sides of the air guide plate are respectively connected to the first air inflow plate and the first air outflow plate; two sides of the volute tongue are respectively connected to the second air inflow plate and the second air outflow plate;

a fan wheel is located between the volute tongue and the air guide plate; and the first air inflow plate has a bended portion configured to bring the air guide plate close to the fan wheel.

2. The wall-mounted air conditioner according to claim 1, wherein a second intersection angle between the centerline of the outlet air duct and a vertical upward direction is greater than or equal to 120 degrees and less than or equal to 155 degrees.

3. The wall-mounted air conditioner according to claim 1, wherein:

the outlet air duct has a first end configured as the air outlet and a second end configured as an air guide port;

a surface passing through a rotation axis of the fan wheel and an upper edge of the air guide port is a first surface; and a third intersection angle between the first surface and a horizontal surface is greater than or equal to 60 degrees and less than or equal to 150 degrees.

4. The wall-mounted air conditioner according to claim 1, wherein:

the outlet air duct has a first end configured as the air outlet and a second end configured as an air guide port;

a surface passing through a rotation axis of the fan wheel and an upper edge of the air guide port is a first surface, and a surface passing through the rotation axis of the fan wheel and a lower edge of the air guide port is a second surface; and a fourth intersection angle between the first surface and the second surface is greater than or equal to 120 degrees and less than or equal to 200 degrees.

5. The wall-mounted air conditioner according to claim 1, wherein:

a highest point of the second air inflow plate is located below a highest point of the first air inflow plate.

6. The wall-mounted air conditioner according to claim 5, wherein a minimum distance between the volute tongue and the fan wheel is greater than or equal to 4 millimeters and less than or equal to 9 millimeters.

7. The wall-mounted air conditioner according to claim 5, wherein a minimum distance between the air guide plate and the fan wheel is greater than or equal to 4 millimeters and less than or equal to 8 millimeters.

8. The wall-mounted air conditioner according to claim 1, wherein a fifth intersection angle between a first flat plate portion, adjacent to the air outlet, of the first air outflow plate and a second flat plate portion, adjacent to the air outlet, of the second air outflow plate is greater than or equal to 5 degrees and less than or equal to 45 degrees.

9. The wall-mounted air conditioner according to claim 1, wherein a sixth intersection angle between a centerline of the outlet air duct and the second air outflow plate is greater than or equal to 0 degree and less than or equal to 30 degrees.

* * * * *